US008727345B2

(12) United States Patent
Konno et al.

(10) Patent No.: US 8,727,345 B2
(45) Date of Patent: May 20, 2014

(54) SHEET DISCHARGING DEVICE, SHEET PROCESSING APPARATUS, IMAGE FORMING SYSTEM, AND SHEET DISCHARGING METHOD

(71) Applicants: Kazunori Konno, Miyagi (JP); Masahiro Tamura, Kanagawa (JP); Shuuya Nagasako, Kanagawa (JP); Tomohiro Furuhashi, Kanagawa (JP); Keisuke Sugiyama, Tokyo (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(72) Inventors: Kazunori Konno, Miyagi (JP); Masahiro Tamura, Kanagawa (JP); Shuuya Nagasako, Kanagawa (JP); Tomohiro Furuhashi, Kanagawa (JP); Keisuke Sugiyama, Tokyo (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/680,814

(22) Filed: Nov. 19, 2012

(65) Prior Publication Data

US 2013/0134659 A1 May 30, 2013

(30) Foreign Application Priority Data

Nov. 29, 2011 (JP) ..... 2011-260855
Jun. 28, 2012 (JP) ..... 2012-145910

(51) Int. Cl.
*B65H 29/24* (2006.01)
*B65H 31/00* (2006.01)

(52) U.S. Cl.
CPC ..... *B65H 29/246* (2013.01); *B65H 29/245* (2013.01); *B65H 29/247* (2013.01)
USPC ..... 271/211; 271/195; 271/207

(58) Field of Classification Search
CPC ..... B65H 29/245–29/247; B65H 5/228
USPC ..... 271/211, 195, 194, 207
See application file for complete search history.

(56) References Cited

U.S. PATENT DOCUMENTS 3,502,407 A * 3/1970 Ellis et al. ..... 399/335
4,036,087 A * 7/1977 Braun ..... 83/79

(Continued)

FOREIGN PATENT DOCUMENTS

FR 1 041 321 10/1953
JP 2011-057313 3/2011
JP 2011057313 A * 3/2011

OTHER PUBLICATIONS

European Search Report dated Mar. 21, 2013.

*Primary Examiner* — Patrick Cicchino
(74) *Attorney, Agent, or Firm* — Harness, Dickey & Pierce, P.L.C.

(57) ABSTRACT

A sheet discharging device includes: sheet discharging rollers that receive each of sheets conveyed thereto and discharge the sheets one by one; a shift tray on which the sheets discharged by the sheet discharging rollers are to be stacked; an air blower; and a CPU. The air blower forms an air layer between the shift tray and a sheet when the sheet is discharged onto the shift tray by the sheet discharging rollers, or between a sheet and the sheet that is already placed on the shift tray when the sheet is discharged. The CPU controls an air velocity of air to be delivered by the air blower based on sheet information, thereby causing the air layer to extend to the entire surface of the sheet.

9 Claims, 15 Drawing Sheets

(56) References Cited

U.S. PATENT DOCUMENTS

| | | | | | |
|---|---|---|---|---|---|
| 4,405,125 | A * | 9/1983 | Kulpa et al. | 271/195 |
| 4,702,468 | A * | 10/1987 | Pollich | 271/195 |
| 5,324,024 | A * | 6/1994 | Mori | 271/296 |
| 6,522,841 | B2 * | 2/2003 | Horikoshi | 399/45 |
| 7,661,671 | B2 * | 2/2010 | Yamazaki et al. | 271/211 |
| 2006/0093420 | A1 * | 5/2006 | Oba | 399/405 |
| 2011/0008087 | A1 * | 1/2011 | Inoue | 399/341 |
| 2012/0093555 | A1 * | 4/2012 | Obuchi | 399/405 |

* cited by examiner

FIG.15A

| | SHEET SIZE | PAPER TYPE | PAPER THICKNESS | AIRFLOW RATE |
|---|---|---|---|---|
| MODE 1 | LARGE | COATED PAPER | THIN | A |
| MODE 2 | | | THICK | B |
| MODE 3 | | ORDINARY PAPER | THIN | C |
| MODE 4 | | | THICK | D |
| MODE 5 | MEDIUM/ SMALL | COATED PAPER | THIN | B |
| MODE 6 | | | THICK | C |
| MODE 7 | | ORDINARY PAPER | THIN | C |
| MODE 8 | | | THICK | D |

*A>B>C>D

FIG.15B

| CLASS | SHEET LENGTH [mm] |
|---|---|
| SMALL SIZE | 139.7 (HLTY)≤x≤216.0 (LTY) |
| MEDIUM SIZE | 216.0 (LTY)<x≤297.0 (A4T) |
| | 297.0 (A4T)<x≤364.0 (B4T) |
| LARGE SIZE | 364.0 (B4T)<x≤432.0 (DLTT) |
| | 432.0 (DLTT)<x≤457.2 (12×18in) |
| | 457.2 (12×18in)<x≤487.7 (13×19.2in) |

SHEET DISCHARGING DEVICE, SHEET PROCESSING APPARATUS, IMAGE FORMING SYSTEM, AND SHEET DISCHARGING METHOD

CROSS-REFERENCE TO RELATED APPLICATIONS

The present application claims priority to and incorporates by reference the entire contents of Japanese Patent Application No. 2011-260855 filed in Japan on Nov. 29, 2011 and Japanese Patent Application No. 2012-145910 filed in Japan on Jun. 28, 2012.

BACKGROUND OF THE INVENTION

1. Field of the Invention

The present invention relates to a sheet discharging device, a sheet processing apparatus, an image forming system, and a sheet discharging method, and more particularly concerns a sheet discharging device configured to deliver air to a sheet of a recording medium (hereinafter simply referred to as a "sheet") such as paper, recording paper, transfer paper, or a transparency when the sheet is discharged to be stacked while being aligned, a sheet processing apparatus that includes the sheet discharging device, an image forming system including the sheet processing apparatus and an image forming apparatus such as a copier, a printer, a facsimile, or a digital multifunction peripheral, and a method implemented by the sheet discharging device.

2. Description of the Related Art

Conventionally, sheet processing apparatuses that perform various processing, e.g., postprocessing such as alignment, stapling, folding, and bookbinding, on sheets ejected from an image forming apparatus are widely known and used. Such a sheet processing apparatus that performs postprocessing is referred to as a sheet postprocessing apparatus below. In recent years, variety of paper that is desired to be processed by sheet postprocessing apparatuses of this type has been noticeably increased. In particular, color image forming apparatuses form images with increasing frequency on coated paper that produces visually-superior images and is commonly used in brochures, leaflets, and the like. Coated paper generally has the following properties.

1) high surface smoothness
2) high inter-sheet clinging force
3) low Clark stiffness These properties can make coated paper less favorable in terms of sheet stacking.

Apparatuses that use a retainer for holding an ejected sheet(s) at a normal position to prevent unfavorable stacking have already been known. Such an apparatus that employs the retainer can prevent a preceding sheet from being pushed out by a subsequent sheet; however, a thin sheet that is easy to buckle can be buckled by sheet clinging and conveyed in a state of clinging to a preceding sheet. This can result in bending of the sheet. To this end, a technique of additionally providing a blower fan for preventing a sheet ejected onto a tray unit from clinging to a sheet already placed on the tray unit is disclosed (in, for example, Japanese Patent Application Laid-open No. 2011-57313).

The technique disclosed in Japanese Patent Application Laid-open No. 2011-57313 prevents undesirable sheet conveyance and sheet ejection by addition of the blower fan; however, disclosed in the technique is only the addition of the blower fan. More specifically, concrete methods concerning, for example, an airflow rate and a direction of air to be delivered by the blower fan, for preventing sheet clinging or sheet bending resulting from sheet clinging are not disclosed. For this reason, although air blowing is expected to be effective in preventing sheet clinging, it is not certain whether application of the technique to a sheet discharging unit of a sheet postprocessing apparatus can reliably prevent sheet clinging and sheet bending.

SUMMARY OF THE INVENTION

It is an object of the present invention to at least partially solve the problems in the conventional technology.

There is need to provide solutions to prevent sheet clinging and sheet bending reliably, thereby attaining favorable alignment accuracy.

A sheet discharging device comprising: a sheet discharging unit configured to receive each of sheets conveyed thereto and discharge the sheets one by one; a tray unit on which the sheets discharged by the sheet discharging unit are to be stacked; an air blower configured to blow air through between the sheet discharging unit and the tray unit to one of the sheets that is being discharged; and a control unit configured to control the air blower based on sheet information.

An image forming system comprising: a sheet processing apparatus including a sheet discharging device; and an image forming apparatus arranged upstream of the sheet processing apparatus and supplying sheets on each of which an image is formed to the sheet processing apparatus.

The sheet discharging device includes; a sheet discharging unit configured to receive each of sheets conveyed thereto and discharge the sheets one by one; a tray unit on which the sheets discharged by the sheet discharging unit are to be stacked; an air blower configured to blow air through between the sheet discharging unit and the tray unit to one of the sheets that is being discharged; and a control unit configured to control the air blower based on sheet information.

A sheet discharging method comprising: discharging, by a discharging unit, each of sheets conveyed to the discharging unit one by one; stacking the sheets discharged by the sheet discharging unit on a tray unit; and blowing air, by an air blower, from between the sheet discharging unit and the tray unit to one of the sheets that is being discharged.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 15A and 15B are diagrams illustrating relations among control modes, sheet information, and airflow rates related to control of the air blowers;

DETAILED DESCRIPTION OF THE PREFERRED EMBODIMENTS

According to an aspect of the present invention, sheet bending and sheet clinging are prevented by reducing close contact between sheets by blowing air to a sheet at an air velocity and in an air-blowing direction that are set based on information about paper type, paper thickness, and sheet size when the sheet is ejected from a sheet output tray, thereby attaining favorable sheet alignment accuracy.

Exemplary embodiments of the present invention are described below with reference to the accompanying drawings.

Figure 1:
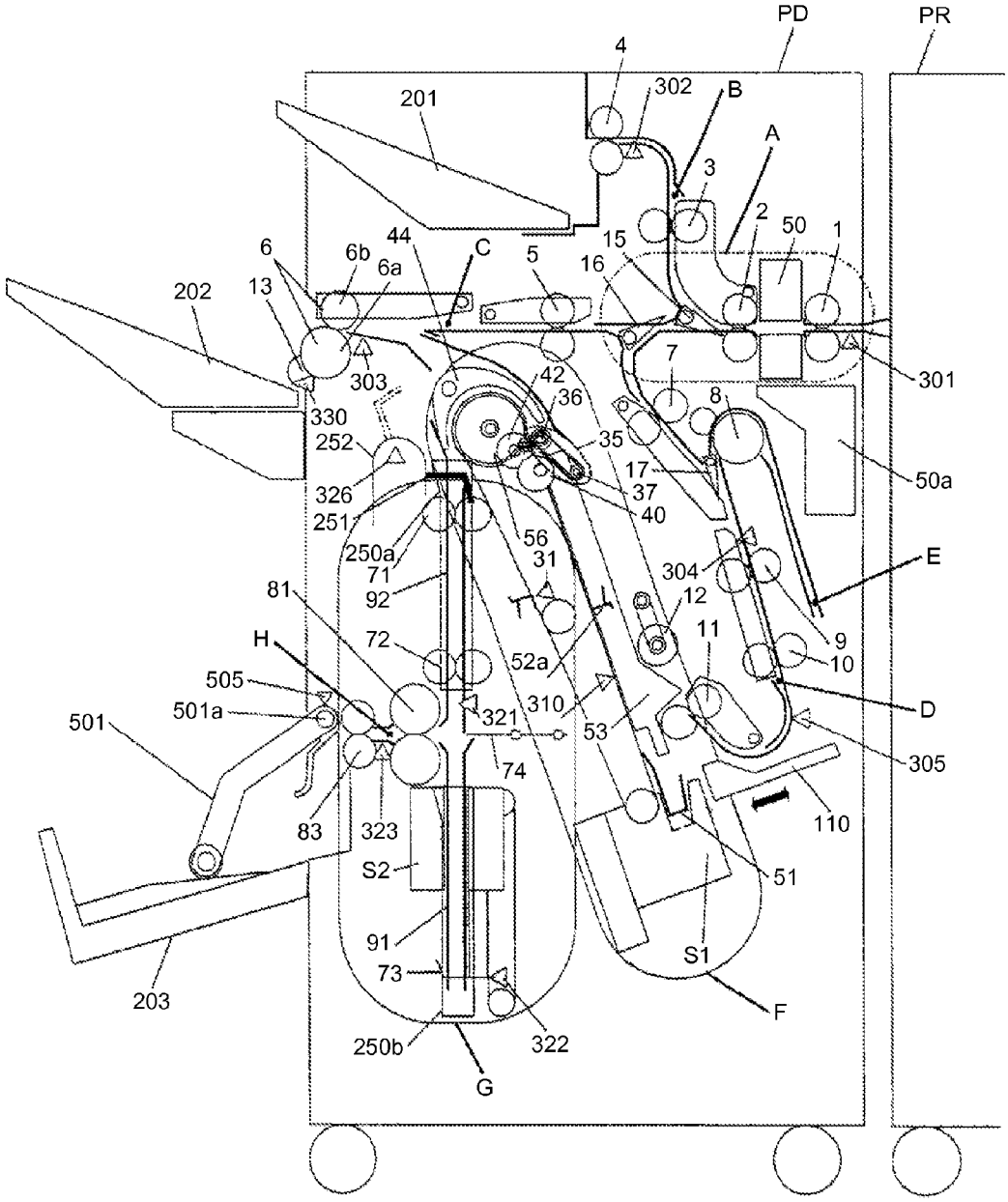
FIG. 1 is a system configuration diagram of an image forming system including an image forming apparatus and a sheet postprocessing apparatus which is a sheet processing apparatus according to an embodiment of the present invention.

FIG. 1 is a system configuration diagram of an image forming system including an image forming apparatus PR and a sheet postprocessing apparatus PD which is a sheet processing apparatus according to the present embodiment.

The image forming apparatus PR illustrated in FIG. 1 includes an image processing circuit, an optical writing device, a developing device, a transfer device, and a fixing device. The image processing circuit converts image data input to the image forming apparatus PR into printable image data. The optical writing device forms a latent image on a photosensitive element by performing optical writing to the photosensitive element according to image signals output from the image processing circuit. The developing device develops the latent image formed on the photosensitive element to obtain a toner image. The transfer device transfers the toner image onto a sheet. The fixing device fixes the toner image onto the sheet. The image forming apparatus PR delivers the sheet on which the toner image is fixed to the sheet postprocessing apparatus PD. The sheet postprocessing apparatus PD performs postprocessing as desired on the sheet. In the present embodiment, the image forming apparatus PR is an electrophotographic image forming apparatus; however, it is not limited thereto, and any known image forming apparatus, e.g., an inkjet printer or a thermal transfer printer, can be used. In the present embodiment, an image forming unit is made up of the image processing circuit, the optical writing device, the development device, the transfer device, and the fixing device.

The sheet postprocessing apparatus PD is arranged alongside the image forming apparatus PR. A sheet ejected from the image forming apparatus PR is delivered into the sheet postprocessing apparatus PD. The sheet postprocessing apparatus PD includes a conveying path A, a conveying path B, a conveying path C, a conveying path D, and a conveying path H. The sheet is conveyed first to the conveying path A on which a postprocessing unit that performs postprocessing on a single sheet is arranged. In the present embodiment, the postprocessing unit is a hole punch unit 50 which is a perforating unit.

The conveying path B extends from the conveying path A and leads to an upper tray 201. The conveying path C leads to a shift tray 202. The conveying path D leads to a processing tray F (hereinafter, also referred to as a "side-stitching tray") where alignment, stapling, and the like are performed. The conveying paths are configured so that a sheet conveyed along the conveying path A is then directed by a first bifurcating claw 15 and a second bifurcating claw 16 to one of the conveying paths B, C, and D.

The sheet postprocessing apparatus PD can perform various sheet processing, such as hole punching (using the hole punch unit 50), sheet alignment and side stitching (using jogger fences 53 and a side-stitching stapler S1), sheet alignment and saddle stitching (using saddle-stitching upper jogger fences 250*a*, saddle-stitching lower jogger fences 250*b*, and a saddle-stitching stapler S2), sheet sorting (using the shift tray 202), and center folding (using a folding plate 74 and folding rollers 81). The conveying path A and one of the conveying paths B, C, and D extending from the conveying path A are selected depending on processing to be performed. The conveying path D includes a sheet holder E. The side-stitching tray F, a saddle-stitching/center-folding tray G, and the sheet-discharging conveying path H are arranged downstream of the conveying path D in a sheet conveying direction.

The conveying path A is an upstream path of each of the conveyance paths B, C, and D and common thereamong. An entry sensor 301 for detecting a sheet received from the image forming apparatus PR is arranged on the conveying path A. Arranged on the conveying path A downstream of the entry sensor 301 are entry rollers 1, the hole punch unit 50, a punch chad basket 50*a*, conveying rollers 2, and the first and second bifurcating claws 15 and 16. The first and second bifurcating claws 15 and 16 are retained at orientations (initial state) illustrated in FIG. 1 by springs (not shown). When a first solenoid (not shown) and a second solenoid (not shown) are turned on, the first bifurcating claw 15 and the second bifurcating claw 16 are driven, respectively. The sheet is directed to a desired one of the conveying path B, C, and D by changing a combination of orientations of the first and second bifurcating claws 15 and 16 that depends on on/off of each of the first and second solenoids.

To guide the sheet to the conveying path B, the state illustrated in FIG. 1 is maintained, or, more specifically, the first solenoid is maintained in the off state (the first bifurcating claw 15 is oriented downward in the initial state). In this state, the sheet passes through conveying rollers 3 and then through upper sheet discharging rollers 4 to be ejected onto the upper tray 201.

To guide the sheet to the conveying path C, the first and second solenoids are turned on (the second bifurcating claw 16 is oriented upward in the initial state) from the state illustrated in FIG. 1 to put the bifurcating claw 15 and the second bifurcating claw 16 in an upwardly pivoted position and a downwardly pivoted position, respectively. In this state, the sheet passes through conveying rollers 5 and then through pairs of sheet discharging rollers 6 (6*a* and 6*b*) to be conveyed toward the shift tray 202. In this case, sheet sorting is performed. The sheet sorting is performed using the shift discharging rollers 6 (6*a* and 6*b*), a return roller 13, a sheet-level detection sensor 330, the shift tray 202, a shift mechanism that causes the shift tray 202 to reciprocate in a direction perpendicular to the sheet conveying direction, and a shift-tray elevating mechanism that moves up or down the shift tray 202.

To guide the sheet to the conveying path D, the first solenoid that drives the first bifurcating claw 15 is turned on and the second solenoid that drives the second bifurcating claw 16 is turned off, thereby putting both the first and second bifurcating claws 15 and 16 in the upwardly pivoted position. In this state, the sheet passes through the conveying rollers 2 and then through conveying rollers 7 to be guided toward the conveying path D. The sheet guided to the conveying path D is further guided onto the side-stitching tray F. Sheets undergone aligning, stapling, and the like on the side-stitching tray F are directed by a guide member 44 to either the conveying path C that leads to the shift tray 202 or the saddle-stitching/center-folding tray G (hereinafter, also simply referred to as a "saddle stitching tray") where the sheets undergo folding and the like. When a sheet bundle PB is to be conveyed to the shift tray 202, the sheet bundle PB passes through the pairs of sheet discharging rollers 6 to be discharged onto the shift tray 202. The sheet bundle PB guided to the saddle-stitching tray G is folded and stapled on the saddle-stitching tray G and conveyed along the sheet-discharging conveying path H. The sheet bundle PB then passes through lower sheet discharging rollers 83 to be discharged onto a lower tray 203.

The conveyance path D includes a bifurcating claw 17 retained in a state illustrated in FIG. 1 by a low-load spring (not shown). After a trailing end of the sheet conveyed by the conveying rollers 7 has passed by the bifurcating claw 17, at least one pair of a pair of conveying rollers 9, a pair of conveying rollers 10, and a pair of to-be-stapled-sheets discharging rollers 11 is rotated in reverse, thereby conveying the sheet backward along a turn guide 8. Thus, with this structure, it is possible to guide the sheet to the sheet holder E where the sheet is to be temporarily retained (pre-stacked) so that the sheet is overlaid by a subsequent sheet and conveyed as a stack. By repeating this process, it is possible to convey a stack of two or more sheets overlaid one another. A reference numeral 304 denotes a pre-stack sensor for use in setting timing at which the conveying direction is to be reversed to guide a sheet to the sheet holder E for pre-stacking.

When the sheet conveyed to the conveying path D is to undergo alignment and side stitching, the sheet is guided by the to-be-stapled-sheets discharging rollers 11 onto the side-stitching tray F. Sheets are stacked on the side-stitching tray F one by one in this way. At this time, the sheets are aligned in a longitudinal direction (the sheet conveying direction) by a tapping roller 12 against trailing-end reference fences 51 (51*a* and 51*b*) each time a sheet is stacked on the side-stitching tray F, while the sheets are aligned against the jogger fences 53 (53*a* and 53*b*) in a lateral direction (the direction perpendicular to the sheet conveying direction; also referred to as the "sheet width direction"). In an interval between consecutive jobs, i.e., in a period between when the last sheet of the sheet bundle PB is placed on the side-stitching tray F and when the first sheet of a subsequent sheet bundle is placed on the same, the side-stitching stapler S1 which is a stapling unit is driven to perform stapling when a stapling signal is fed from a central processing unit (CPU) 101, which will be described later. Immediately after the stapling, the stapled sheet bundle PB is conveyed by an ejection belt 52 (see FIG. 2) from which ejection tabs 52*a* project to the pairs of (shift) sheet discharging rollers 6, which in turn discharge the sheet bundle PB onto the shift tray 202 which is on standby at a receiving position.

Figure 2:
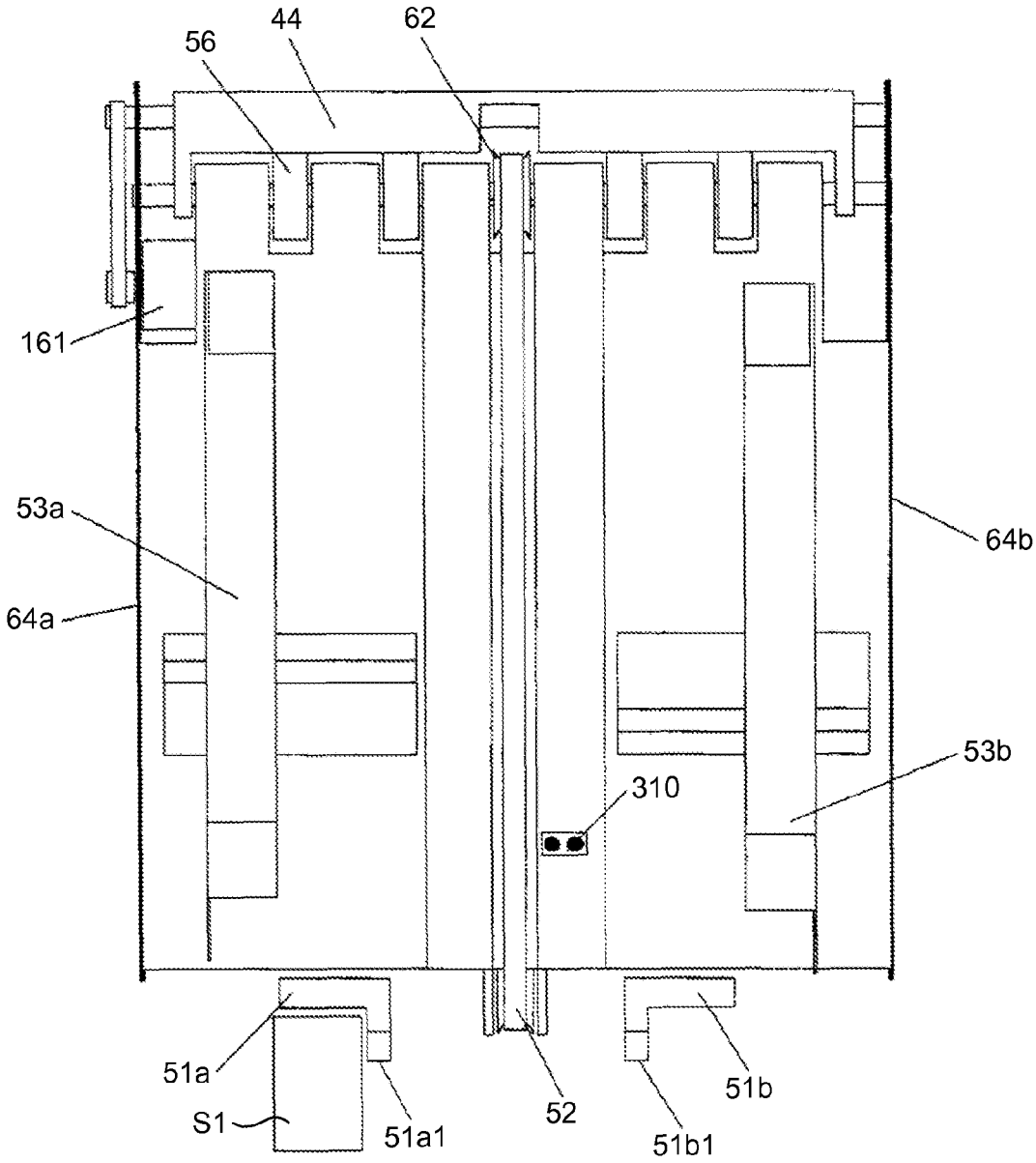
FIG. 2 is a schematic configuration diagram of a side-stitching tray illustrated in FIG. 1 as viewed from a sheet-loading surface side of the tray.
Figure 4:
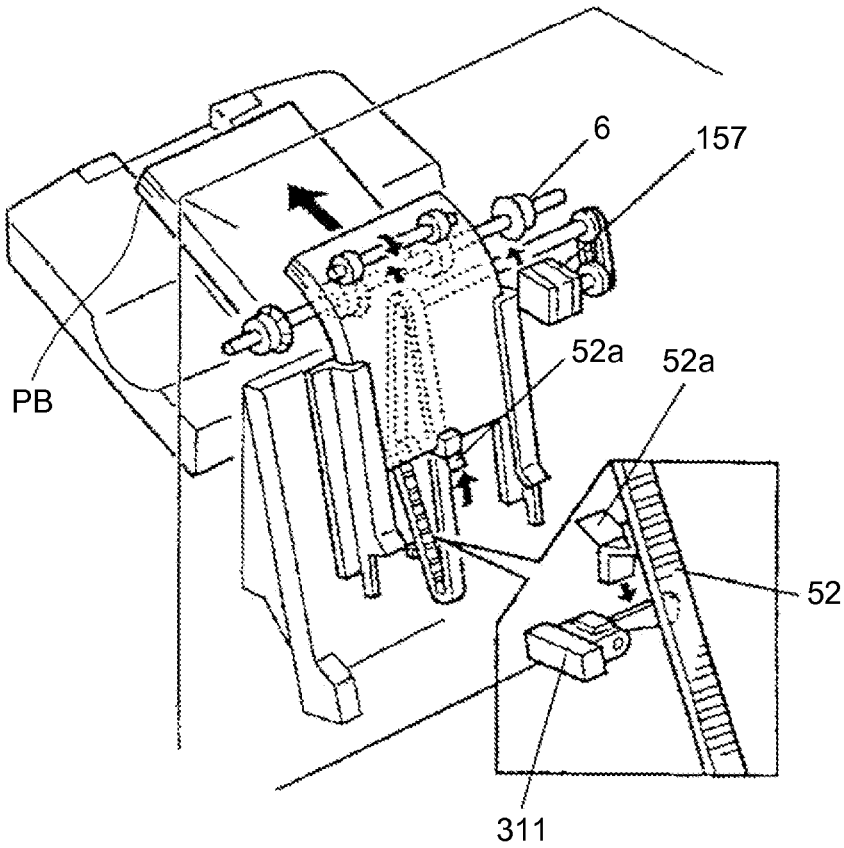
FIG. 4 is a perspective view illustrating an operation of an ejection belt illustrated in FIG. 1.

As illustrated in FIGS. 2 and 4, the ejection belt 52 is positioned at the center of aligned sheets in the sheet width direction, laid around pulleys 62 in a tensioned manner, and driven by an ejection-belt driving motor 157. A plurality of ejection rollers 56 are arranged to be symmetric with respect to the ejection belt 52 and rotatable relative to a drive shaft to function as driven rollers.

A home position (HP) of the ejection tabs 52*a* is detected by an ejection-belt HP sensor 31. Each of the ejection tabs 52*a* provided on the ejection belt 52 switches on/off an ejection-belt HP sensor 311(see FIG. 4). The ejection tabs 52*a* are provided on an outer circumferential surface of the ejection belt 52 at two positions where the ejection tabs 52*a* face each other, and alternately move and convey the sheet bundle PB housed in the side-stitching tray F. It is also possible to rotate the ejection belt 52 in reverse as required, thereby aligning leading ends of sheets of the sheet bundle PB in the conveying direction housed in the side-stitching tray F against one of the ejection tabs 52*a* that is on standby to be ready for moving the sheet bundle PB and a back surface of the other one of the ejection tabs 52*a*.

In FIG. 1, a reference numeral 110 denotes a trailing-end holding lever. The trailing-end holding lever 110 is arranged at a bottom end portion of the trailing-end reference fences 51 so that the trailing-end holding lever 110 can retain the trailing end of the sheet bundle PB housed in the trailing-end reference fences 51, and reciprocates in a direction substantially orthogonal to the side-stitching tray F. Each sheet P ejected onto the side-stitching tray F is aligned by the tapping roller 12 in the longitudinal direction (in the sheet conveying direction); however, in a case where a trailing end of the sheet P placed on the side-stitching tray F is curled or the sheet P is easy to buckle, the trailing end is likely to be bent under its own weight and increased in thickness. Furthermore, as the number of stacked sheets increases, space provided in the trailing-end reference fences 51 into which a subsequent sheet is to be inserted becomes small. When the space is small, alignment accuracy in the longitudinal direction is likely to decrease. A trailing-end holding mechanism is employed to reduce an increase in the thickness at a sheet trailing end PT to facilitate insertion of the sheet P into the space provided in the trailing-end reference fences 51. This mechanism includes the trailing-end holding lever 110 that directly holds the sheet P or the sheet bundle PB.

In FIG. 1, reference numerals 302, 303, 304, 305, and 310 denote sheet detection sensors each of which detects whether a sheet has passed by a position where the detection sensor is provided or whether a sheet is stacked at a position where the detection sensor is provided.

FIG. 2 is a schematic configuration diagram of the side-stitching tray F as viewed from a sheet-loading surface side of the tray, or, in other words, as viewed from the right side in FIG. 1. Referring to FIG. 2, a sheet received from the image forming apparatus PR which is upstream of the sheet post-processing apparatus PD is aligned against the jogger fences 53*a* and 53*b* in the sheet width direction, and aligned in the longitudinal direction by being abutted on the trailing-end reference fences 51*a* and 51*b* (indicated by reference numeral 51 in FIG. 1). The trailing-end reference fences 51*a* and 51*b* include, on their inner sides, stack surfaces 51*a*1 and 51*b*1, respectively, where the sheet trailing end PT (see FIG. 3) is to abut and be held. The stack surfaces 51*a*1 and 51*b*1 support the sheet trailing end PT in a two-point-support manner. After completion of the alignment, the side-stitching stapler S1 staples the sheet bundle PB. As can be seen from the perspective view of FIG. 4 that illustrates an operation of the ejection belt 52, the ejection belt 52 is rotated counterclockwise by the ejection-belt driving motor 157. As a result, the trailing-end reference fences 51*a* and 51*b* push up the stapled sheet bundle PB to a predetermined position where the sheet bundle PB is lifted up and ejected from the side-stitching tray F by the ejection tab 52*a* on the ejection belt 52. Reference numerals 64*a* and 64*b* denote a front side plate and a back side plate, respectively. This operation can be similarly performed on a not-stapled sheet bundle that is aligned but not stapled.

Figure 3:
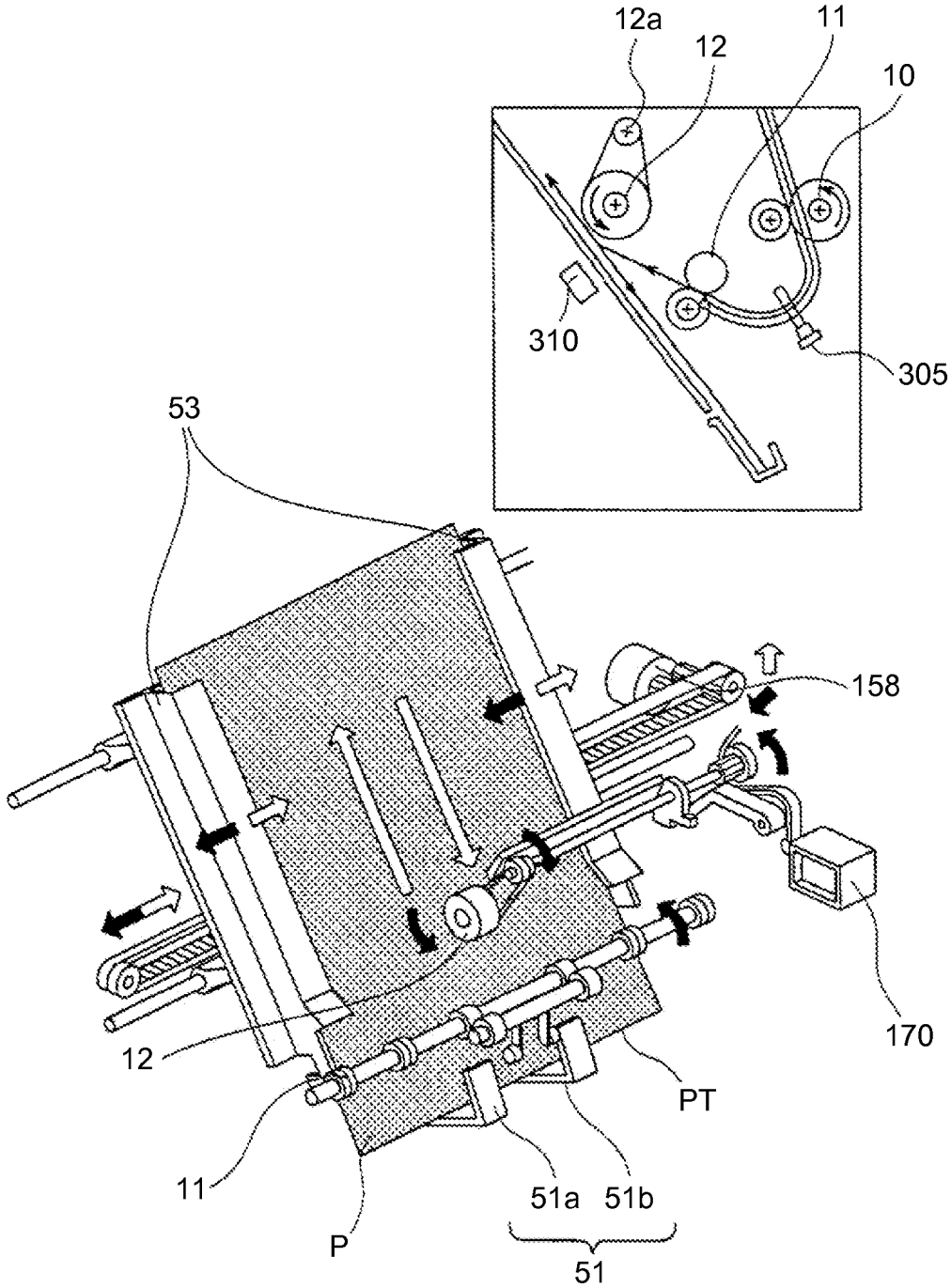
FIG. 3 is a perspective view illustrating a schematic configuration of the side-stitching tray and mechanisms relevant thereto.

FIG. 3 is a perspective view illustrating a schematic configuration of the side-stitching tray F and mechanisms relevant thereto. As illustrated in FIG. 3, the sheets P conveyed by the to-be-stapled-sheets discharging rollers 11 to the side-stitching tray F are stacked on the side-stapling tray F one by one. At this time, when the number of the sheets P ejected onto the side-stitching tray F is one, sheet alignment is performed on each sheet in the longitudinal direction (the sheet conveying direction) between the tapping roller 12 and the trailing-end reference fences 51, and also sheet alignment is performed in the width direction (the sheet width direction perpendicular to the sheet conveying direction) against the jogger fences 53*a* and 53*b*. The tapping roller 12 is driven to swing on a fulcrum 12*a* by a tapping solenoid (SOL) 170. Thus, the tapping roller 12 intermittently acts on the sheets delivered onto the side-stitching tray F to cause the sheets to abut on the trailing-end reference fences 51. Meanwhile, the tapping roller 12 rotates counterclockwise in FIG. 3. As illustrated in FIGS. 2 and 3, the pair of jogger fences 53 (53*a* and 53*b*) is arranged on opposite sides across the width of sheets. A reversible jogger motor 158 drives the pair of jogger fences 53 via a timing belt to thereby move the jogger fences 53 in a reciprocating manner toward and away from each other in the sheet width direction.

Referring back to FIG. 1, a sheet-bundle deflecting mechanism is arranged downstream of the side-stitching tray F in the sheet conveying direction. The sheet-bundle deflecting mechanism includes a conveying path for conveying the sheet bundle PB from the side-stitching tray F to the saddle-stitching tray G or from the side-stitching tray F to the shift tray 202 and a conveying unit that conveys the sheet bundle PB. The conveying path and the conveying unit are formed of a conveying mechanism 35 that applies a conveying force to the sheet bundle PB, the ejection rollers 56 that cause the sheet bundle PB to make a turn, and the guide member 44 that guides the sheet bundle PB so as to make the turn.

Configurations of these components are described in detail below. The conveying mechanism 35 includes a drive shaft 37 and a roller 36 to which a driving force of the drive shaft 37 is transmitted via a timing belt. The roller 36 and the drive shaft 37 are connected and supported by an arm in such a manner that the roller 36 can pivot about the drive shaft 37 as a fulcrum of rotation. A cam 40 causes the roller 36 of the conveying mechanism 35 to pivot. The cam 40 is driven by a motor (not shown) to rotate about a rotary shaft. In the conveying mechanism 35, a driven roller 42 is arranged at a position where the driven roller 42 faces the roller 36. The sheet bundle PB is pinched between the driven roller 42 and the roller 36 and elastically pressed. The conveying force is thus applied to the sheet bundle PB.

The conveying path along which the sheet bundle PB exited from the side-stitching tray F is turned to the saddle-stitching tray G is formed between the ejection rollers 56 and an inner surface, which on the side where the guide member 44 faces the ejection rollers 56, of the guide member 44. The guide member 44 is driven to pivot about a fulcrum on a driving force transmitted to the guide member 44 from a bundle-bifurcation driving motor 161 (see FIG. 2). To convey the sheet bundle PB from the side-stitching tray F to the shift tray 202, the guide member 44 pivots clockwise in FIG. 1 about the fulcrum so that a clearance between an outer surface (the surface on the side where the guide member 44 does not face the ejection rollers 56) of the guide member 44 and a guide plate on the outside of the outer face functions as a conveying path. To deliver the sheet bundle PB from the side-stitching tray F to the saddle-stitching tray G, the ejection tab 52*a* lifts up the trailing end of the sheet bundle PB aligned on the side-stitching tray F. The roller 36 of the conveying mechanism 35 and the driven roller 42 facing the roller 36 pinch the sheet bundle PB therebetween to apply the conveying force to the sheet bundle PB. Before pinching the sheet bundle PB, the roller 36 of the conveying mechanism 35 is on standby at a position where the roller 36 does not contact the leading end of the sheet bundle PB. Then, after the leading end of the sheet bundle PB has passed by the roller 36 of the conveying mechanism 35, the roller 36 is brought into contact with the sheet surface to apply the conveying force to the sheet bundle PB. At this time, the guide member 44 and the ejection rollers 56 form a guide to convey the sheet bundle PB downstream to the saddle-stitching tray G.

As illustrated in FIG. 1, the saddle-stitching tray G is arranged downstream from the sheet-bundle deflecting mechanism that includes the conveying mechanism 35, the guide member 44, and the ejection roller 56. The saddle-stitching tray G is arranged downstream of the sheet-bundle deflecting mechanism in a substantially vertical orientation. The saddle-stitching tray G includes a center folding mechanism at a center portion, and an upper bundle-conveyance guide plate 92 and a lower bundle-conveyance guide plate 91 above and below the center folding mechanism, respectively.

Upper bundle conveying rollers 71 and lower bundle conveying rollers 72 are provided in an area above the upper bundle-conveyance guide plate 92 and an area below the same, respectively. The saddle-stitching upper jogger fences 250*a* are arranged along side surfaces of the upper bundle-conveyance guide plate 92 in a manner to straddle the rollers 71 and 72. Similarly, the saddle-stitching lower jogger fences 250*b* are provided along side surfaces of the lower bundle-conveyance guide plate 91 on both sides thereof. The saddle-stitching stapler S2 is arranged at a position where the saddle-stitching lower jogger fences 250*b* are provided. The saddle-stitching upper jogger fences 250*a* and the saddle-stitching lower jogger fences 250*b* are driven by a driving mechanism (not shown) and perform alignment in the direction perpendicular to the sheet conveyance direction (the sheet width direction). The saddle-stitching stapler S2 includes two stapler units that are spaced from each other a predetermined distance in the sheet width direction. Each stapler unit includes a pair of a clincher unit and a driving unit.

A movable trailing-end reference fence 73 extends across the lower bundle-conveyance guide plate 91. A moving mechanism including a timing belt and a drive mechanism for the timing belt allows the movable trailing-end reference fence 73 to move in the sheet conveying direction (in the up/down direction in FIG. 1). As illustrated in FIG. 1, the drive mechanism includes a drive pulley and a driven pulley between and around which the timing belt is laid, and a stepping motor that drives the drive pulley. Similarly, a trailing-end tapping member 251 and a drive mechanism for the trailing-end tapping member 251 are arranged at a top end portion of the upper bundle-conveyance guide plate 92. The trailing-end tapping member 251 is driven by a drive mechanism (not shown) via a timing belt 252 to move in a reciprocating manner in a direction away from the sheet-bundle deflecting mechanism and a direction in which the trailing-end tapping member 251 presses the trailing end (i.e., the downstream end of the sheet bundle PB conveyed onto the saddle-stitching tray G) of the sheet bundle PB.

The center folding mechanism positioned at a substantially center portion of the saddle-stitching tray G includes the folding plate 74, the folding rollers 81, and the conveying path H along which the folded sheet bundle PB is conveyed. In FIG. 1, a reference numeral 326 denotes an HP sensor for detecting a home position of the trailing-end tapping member 251; 323 denotes a crease passage sensor for detecting a center-folded sheet bundle; 321 denotes a bundle detection sensor for detecting arrival of the sheet bundle PB at a center-folding position; 322 denotes a movable-trailing-end-reference-fence HP sensor for detecting a home position of the movable trailing-end reference fence 73.

In the present embodiment, a detection lever 501, which is pivotable on a fulcrum 501*a*, that detects a stack height of the center-folded sheet bundle PB is arranged on the lower tray 203. A sheet level sensor 505 detects an angle of the detection lever 501. Ascending/descending of the lower tray 203 and tray-full detection of the same are performed based on the detected angle.

Figure 5:
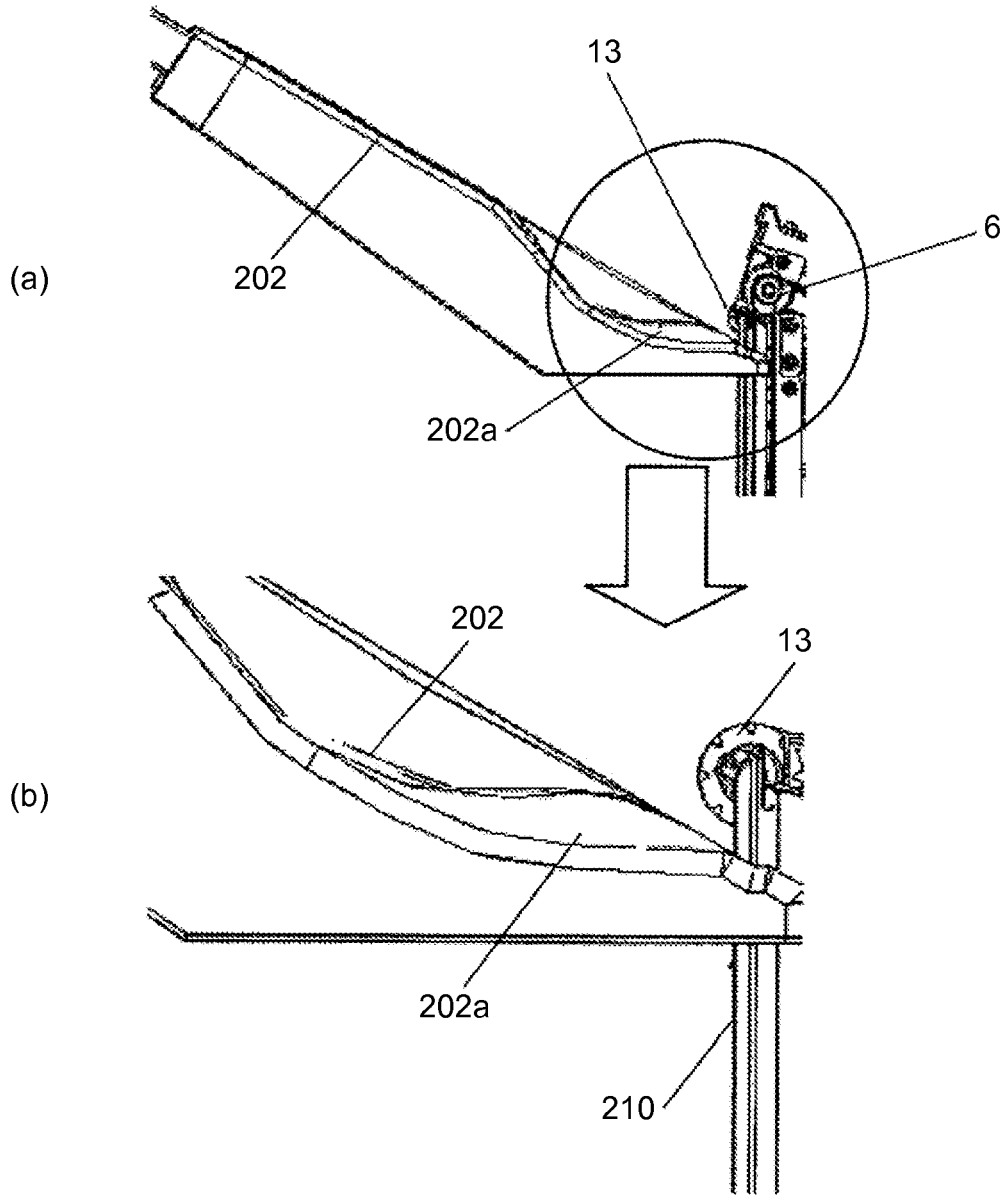
FIG. 5 is a diagram illustrating relevant portions of a shift tray illustrated in FIG. 1 that is in a standby state.

FIG. 5 is a diagram of relevant portions of a sheet discharging unit for the shift tray 202. FIG. 5(*a*) is a diagram illustrating a sheet-discharging standby state. FIG. 5(*b*) is an enlarged view of the circled portion of FIG. 5(*a*). As described above, sheets are conveyed by the pairs of sheet discharging rollers 6 (6*a* and 6*b*) to the shift tray 202 where sheet sorting is performed. The sheet sorting is performed as described above using the pairs of shift discharging rollers 6 (6*a* and 6*b*), the return roller 13, the shift tray 202, the shift mechanism, and the shift-tray elevating mechanism.

Figure 6:
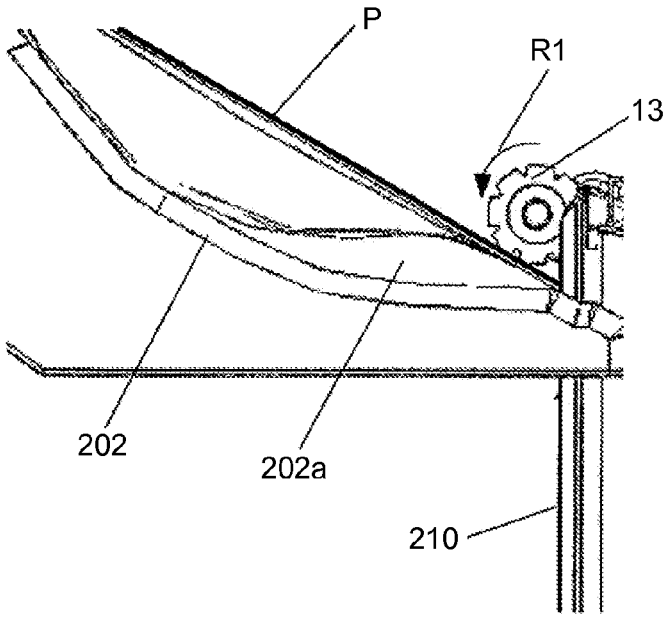
FIG. 6 is an explanatory diagram of an alignment operation in a sheet conveying direction performed on the shift tray.

FIG. 6 is an explanatory diagram of an alignment operation in the sheet conveying direction. The alignment operation is performed on the sheet P ejected onto the shift tray 202 in such a manner that the return roller 13 that is rotating in the direction (direction indicated by arrow R1) in which the sheet P is moved back toward an end fence 210 contacts the sheet P, thereby actively bringing the sheet P back toward the end fence 210. The return roller 13 is driven by a return-roller driving motor (not shown). A driving force generated by the return-roller driving motor is transmitted to the return roller 13 via a timing belt (not shown).

Figure 7:
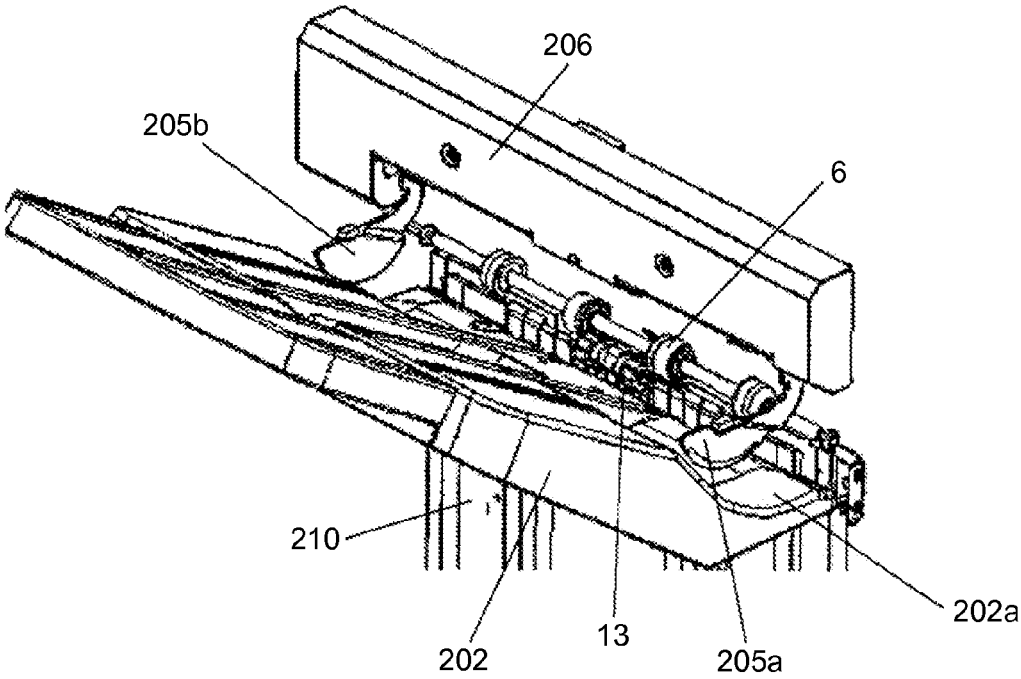
FIG. 7 is a perspective view of a sheet discharging unit including the shift tray and sheet discharging rollers.

FIG. 7 is a perspective view of the sheet discharging unit that includes the shift tray 202 and the sheet discharging rollers 6. As illustrated in FIG. 7, a pair of joggers 205*a* and 205*b* that aligns the sheets P in the width direction on the shift tray 202 are arranged above the shift tray 202. The joggers 205*a* and 205*b* are movable in the width direction of the sheets P by being driven by a jogger driving mechanism 206. The jogger driving mechanism 206 has a known structure and its mechanism does not have direct bearing on the present invention; accordingly, detailed description about the jogger driving mechanism 206 is omitted. A reference numeral 202*a* in FIG. 5 and other drawings denotes a relief (recess) provided to permit the joggers 205*a* and 205*b* to move.

Figure 8:
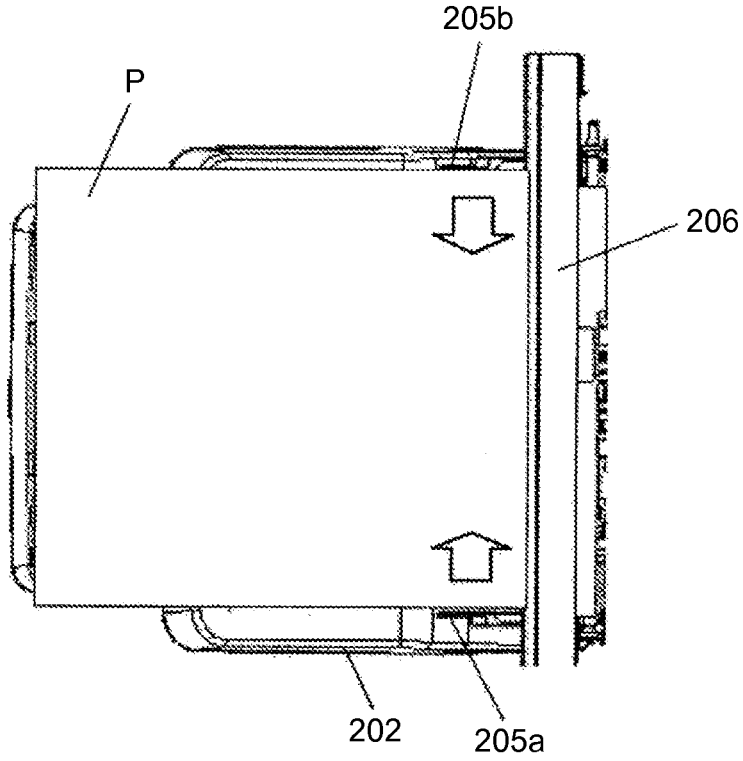
FIG. 8 is a diagram illustrating an alignment operation in a sheet width direction performed on the shift tray.
Figure 9:
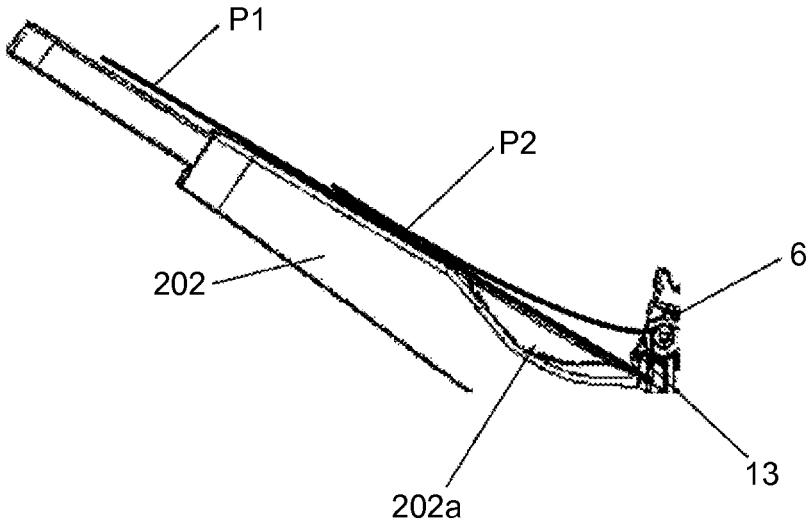
FIG. 9 is a diagram illustrating a state where a succeeding sheet is ejected onto the shift tray where a preceding sheet is already placed.
Figure 10:
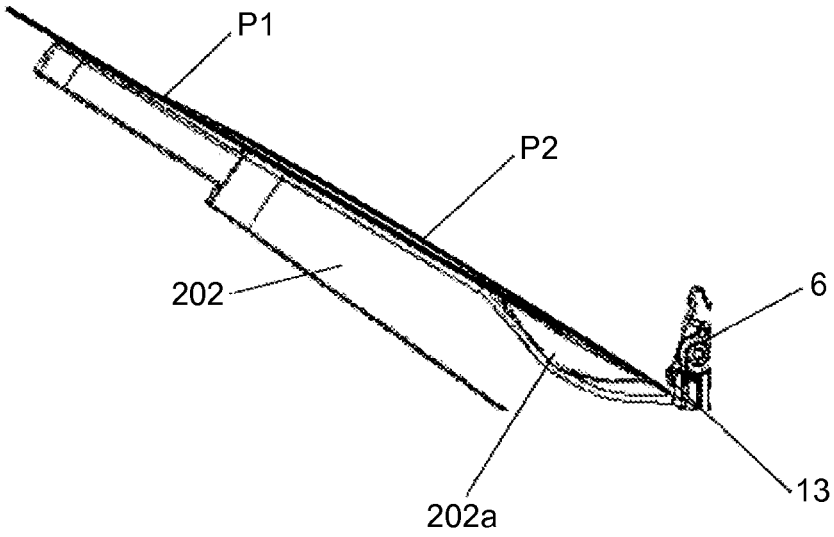
FIG. 10 is a diagram illustrating a state, continued from the state illustrated in FIG. 9, where sheet clinging resulting from close contact between the sheets has caused the succeeding sheet to push out the preceding sheet.

FIG. 8 is a diagram illustrating an alignment operation in the sheet width direction performed on the shift tray 202. The alignment operation is performed by aligning a sheet ejected onto the shift tray 202 in the width direction by sandwiching the sheet P between the jogger 205*a* from one side in the sheet width direction and the jogger 205*b* from the other side in the sheet width direction. However, in a case where the sheet P has high smoothness as does coated paper, when a subsequent sheet P2 is ejected onto the shift tray 202 where a preceding sheet P1 is already placed as illustrated in FIG. 9, sheet clinging can occur due to close contact between the sheets. As a result, the subsequent sheet P2 contacting the preceding sheet P1 can undesirably push out the preceding sheet P1 as illustrated in FIG. 10.

To prevent the preceding sheet P1 from being pushed out in this manner, the sheet discharging unit according to the present embodiment includes an air blower. The air blower blows air between the preceding sheet P1 and the subsequent sheet P2 when the subsequent sheet P2 is ejected, thereby preventing the subsequent sheet P2 from clinging to the preceding sheet P1.

Figure 11:
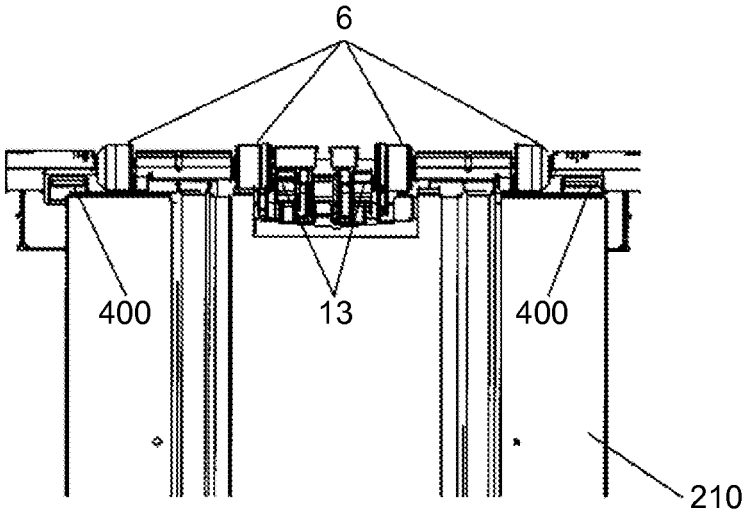
FIG. 11 is a front view of relevant portions of the sheet discharging unit illustrated in FIG. 1.
Figure 12:
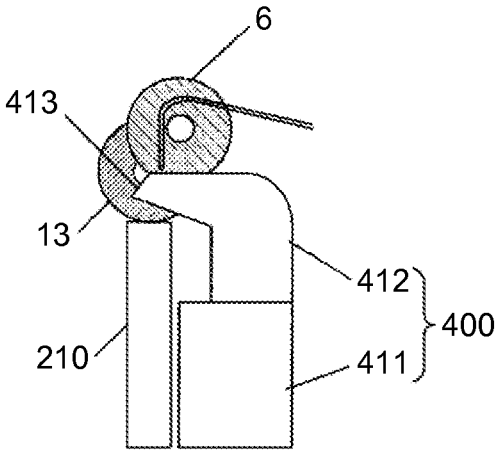
FIG. 12 is a cross-sectional view of the relevant portions illustrated in FIG. 11 as viewed from the right side of FIG. 11.

FIG. 11 is a front view of relevant portions of the sheet discharging unit that includes air blowers according to the present embodiment. FIG. 12 is a cross-sectional view of the relevant portions viewed from the right side of FIG. 11. Referring to FIGS. 11 and 12, a pair of air blowers 400 are arranged on widthwise outer sides of the four pairs of sheet discharging rollers 6 that are arranged in the sheet width direction. As illustrated in FIG. 12, each of the air blowers 400 includes a blower fan 411 and an air-blow guide 412. The blower fan 411 is driven by a motor (not shown) to blow air from a blowing nozzle 413 of the air-blow guide 412 at an air velocity that depends on the rotation speed of the motor. The sheet discharging unit according to the present embodiment includes the two air blowers 400; however, as a matter of course, the sheet discharging unit may include three or more air blowers to be adaptable to wide sheets, for example.

The blowing nozzle 413 has an opening at a level lower than the pairs of sheet discharging rollers 6 and higher than the shift tray 202 as illustrated in FIG. 12. This positioning of the opening allows the blowing nozzles 413 to blow air between a top surface of the shift tray 202 and a sheet that is being discharged from the pairs of sheet discharging rollers 6. Air is blown by the blower fan 411 driven by the motor that is under control of the CPU 101 of the sheet postprocessing apparatus PD. More specifically, the CPU 101 of the sheet postprocessing apparatus PD determines whether air is to be blown based on sheet information fed from the image forming apparatus PR. When it is determined that air is to be blown, the CPU 101 controls the motor so as to rotate.

Figure 13:
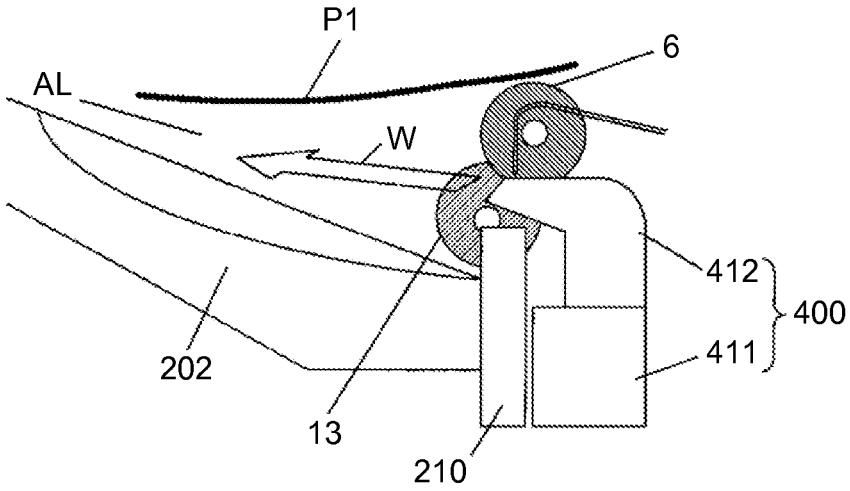
FIG. 13 is an explanatory diagram of an operation of air blowers illustrated in FIG. 12 and illustrating a state where the first sheet is discharged.

FIGS. 13 to 15B are explanatory diagrams illustrating operations of the air blowers 400. As illustrated in FIG. 13, when the sheet P1 is ejected onto the shift tray 202, the blower fan 411 of each of the air blowers 400 is driven to deliver airflow w to a back-surface side of the sheet P1. This air blowing operation forms an air layer AL between the shift tray 202 and the sheet P1. The sheet P1 that has fallen on the shift tray 202 and moved underneath the return roller 13 while displacing the air layer AL is conveyed by the return roller 13 in the direction opposite to the conveying direction. The trailing end of the sheet P1 abuts on the end fence 210 to thus be aligned in the sheet conveying direction.

Figure 14:
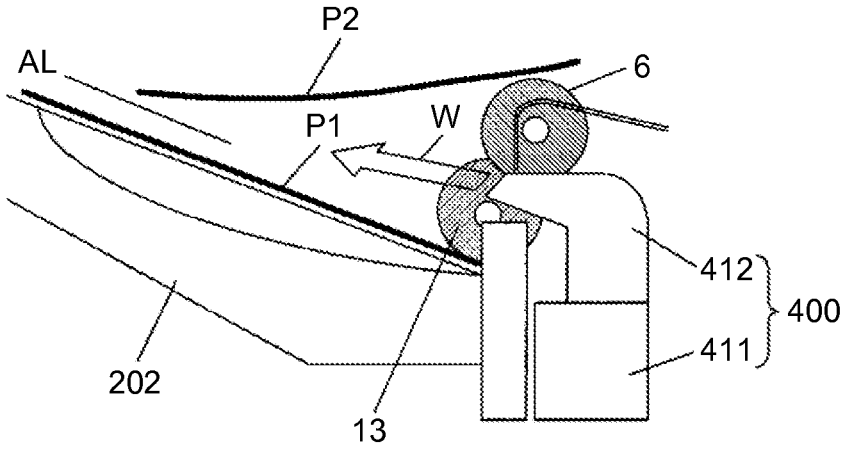
FIG. 14 is an explanatory diagram of the operation of the air blowers illustrated in FIG. 12 and illustrating a state where the second sheet is discharged.

Subsequently, the joggers 205*a* and 205*b* perform sheet alignment in the sheet width direction. When the subsequent sheet P2 is to come into contact with the preceding sheet P1 as illustrated in FIG. 14 after completion of the sheet alignment in the conveying direction and the width direction, the air blowers 400 are also driven to deliver the airflow W to a back-surface side of the sheet P2. This air blowing forms the air layer AL between the preceding sheet P1 and the subsequent sheet P2, thereby preventing or reducing close contact between the sheets.

Example 1

Control operations performed by the CPU 101 are described below by way of Example 1 and Example 2.

Example 1 is an example in which the CPU 101 performs air-blowing control based on sheet information about a sheet to be discharged. The CPU 101 of the sheet postprocessing apparatus PD causes air to be blown when the CPU 101 determines that sheet clinging can occur based on sheet information about a sheet delivered from the image forming apparatus PR to the sheet postprocessing apparatus PD and to be discharged therefrom. The sheet information fed from the image forming apparatus PR includes sheet-type information indicating ordinary paper, coated paper, tracing paper, or the like, paper-thickness information indicating thick paper, thin paper, or the like, and sheet-size information indicating A3, A4, B4, or the like. When the airflow w is to be delivered between the preceding sheet P1 and the subsequent sheet P2 as illustrated in FIG. 14, an airflow rate of the airflow w is set to a value optimum for preventing sheet clinging based on the sheet information including information about paper type, paper thickness, and sheet size transmitted from the image forming apparatus PR so that the air layer AL extends to the entire sheet surface. In the present embodiment, this airflow rate setting is performed by selecting appropriate one of Mode 1 to Mode 8 which are control modes preset as illustrated in FIG. 15. FIGS. 15A and 15B are diagrams illustrating relations among the control modes, the sheet information, and airflow rates.

FIG. 15A illustrates a concrete example of the relations among Modes 1 to 8, the sheet information, and airflow rates in tabular form. FIG. 15B illustrates a concrete example of sheet size classification into small-size, medium-size, and large-size groups in tabular form. Referring to FIG. 15A, the sheet information includes information about paper size, paper type, and paper thickness; airflow rates are classified into four grades of A, B, C, and D (A>B>C>D). In the present embodiment, Modes 1 to 8 are set as follows.

- Mode 1: airflow rate for a large-sized sheet of coated thin paper is A
- Mode 2: airflow rate for a large-sized sheet of coated thick paper is B
- Mode 3: airflow rate for a large-sized sheet of ordinary thin paper is C
- Mode 4: airflow rate for a large-sized sheet of ordinary thick paper is D
- Mode 5: airflow rate for a medium/small-sized sheet of coated thin paper is B
- Mode 6: airflow rate for a medium/small-sized sheet of coated thick paper is C
- Mode 7: airflow rate for a medium/small-sized sheet of ordinary thin paper is C
- Mode 8: airflow rate for a medium/small-sized sheet of ordinary thick paper is D In the present embodiment, to which one of the small-size, medium-size, and large-size groups a sheet is classified is determined based on the sheet length as illustrated in FIG. 15B, for example. A sheet whose length is equal to or greater than the half width of the letter size and equal to or smaller than the width of the letter size is classified as the small-sized sheet. A sheet whose length is greater than the width of the letter size and equal to or smaller than the length of the A4 size, or a sheet whose length is greater than the length of the A4 size and equal to or smaller than the length of the B4 size is classified as the medium-sized sheet. A sheet whose length is greater than the length of the B4 size and equal to or smaller than the length of the double letter size, a sheet whose length is greater than the length of the double letter size and equal to or smaller than 12.0×18.0 inches, or a sheet whose length is greater than 12.0×18.0 inches and equal to or smaller than 13.0×19.2 inches is classified as the large-sized sheet. These sizes are indicated in millimeters in FIG. 15B.

Namely, in the present embodiment, strength of air blown onto the ejected sheet is adjusted so that the air layer AL extends to the entire sheet surface. The optimum air velocity (or airflow rate) is determined by the CPU 101 by referring to actually-measured data stored in a memory. The measured data is obtained in advance by measuring, in a laboratory, optimum air velocities (or airflow rates) for causing the air layer AL to extend to the entire sheet surface with paper type, paper thickness, and sheet size as variables and stored in the memory in a tabular form. The airflow rates A, B, C, and D are set in this way. A user can manually adjust the air velocity (or airflow rate) by inputting a numerical value or making a choice from an operation panel 105 of the image forming apparatus PR.

Figure 16:
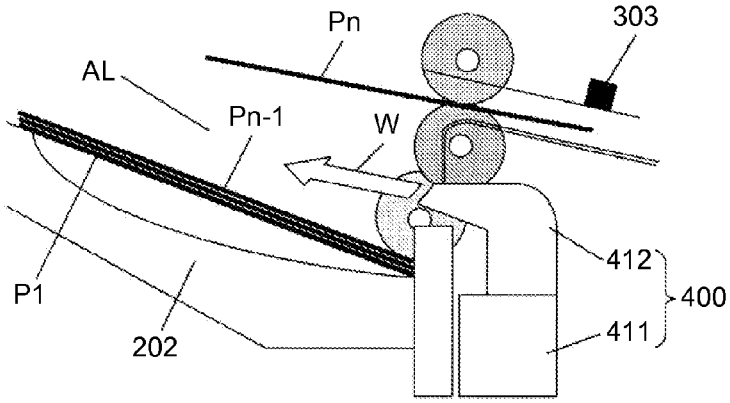
FIG. 16 is an explanatory diagram of the operation of the air blowers illustrated in FIG. 12 and illustrating a state where the last sheet is discharged.

Air blowing is started when the image forming apparatus PR starts feeding sheets to the sheet postprocessing apparatus PD and stopped after t seconds from when a trailing end of a sheet Pn which is the last sheet of the sheets passes by the sheet detection sensor 303 as illustrated in FIG. 16. The value of t is set depending on the sheet information about paper type, paper thickness, and sheet size as in the case of the air velocity.

Figure 17A:
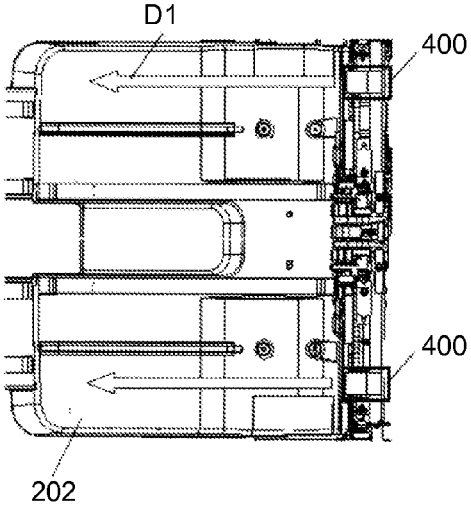
FIGS. 17A and 17B are diagrams illustrating air-blowing directions on the shift tray.
Figure 17B:
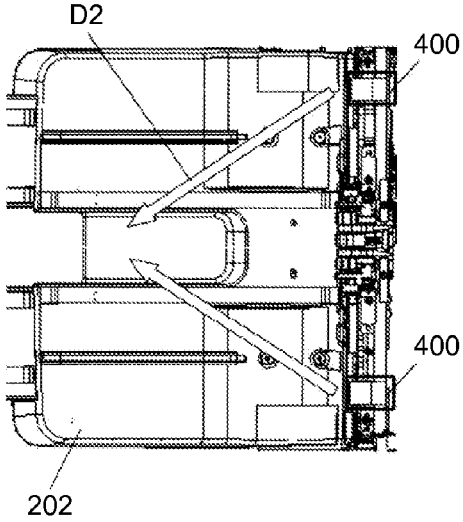

FIGS. 17A and 17B are diagrams illustrating air-blowing directions. The air blowers 400 deliver the airflow W in a direction (indicated by arrows D1) parallel to the sheet conveying direction or in inward directions (indicated by arrows D2) at a predetermined angle relative to the sheet conveying direction. The air-blowing directions can be adjusted by adjusting the orientations of the blowing nozzles 413. For this reason, the blowing nozzles 413 may be either fixed or movable.

Figure 18:
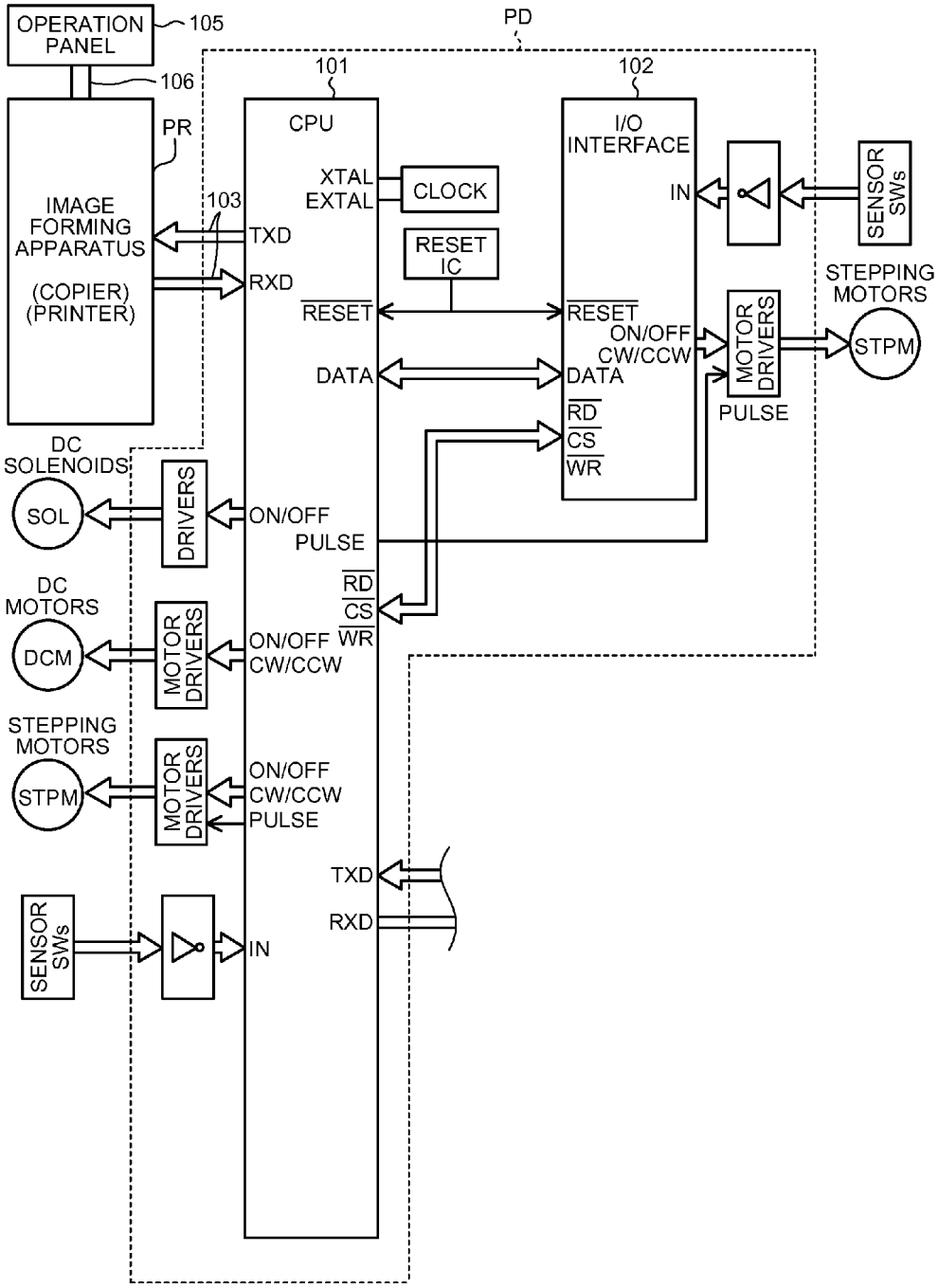
FIG. 18 is a block diagram illustrating a control structure of the image forming system including the image forming apparatus and the sheet postprocessing apparatus.

FIG. 18 is a block diagram illustrating a control structure of the image forming system including the sheet postprocessing apparatus PD and the image forming apparatus PR. The sheet postprocessing apparatus PD includes a control circuit equipped with a microcomputer that includes the CPU 101 and an input/output (I/O) interface 102. Signals are input to the CPU 101 from a CPU, switches, and the like of the operation panel 105 of the image forming apparatus PR, or from sensors (not shown) via a communication interface 103. The CPU 101 performs predetermined control according to the input signal. The CPU 101 also controls solenoids and motors via drivers and motor drivers and acquires detection information output from sensors in the apparatus via interfaces. The CPU 101 also controls motors using motor drivers via the I/O interface 102 according to a control target and sensors, and acquires detection information from the sensors. The CPU 101 performs control operations described above by reading out program codes stored in a read only memory (ROM) (not shown), loading them into a random access memory (RAM) (not shown), and executing programs defined by the program codes while using the RAM as a working area and a data buffer.

The sheet postprocessing apparatus PD is controlled as illustrated in FIG. 18 according to an instruction or data fed from the CPU of the image forming apparatus PR. An instruction from a user is supplied to the sheet postprocessing apparatus PD from the operation panel 105 of the image forming apparatus PR. The operation panel 105 and the image forming apparatus PR are mutually connected via a communication interface 106. Accordingly, an operation signal input from the operation panel 105 is transmitted from the image forming apparatus PR to the sheet postprocessing apparatus PD. An operating status and a function of the sheet postprocessing apparatus PD are indicated to a user via the operation panel 105.

Accordingly, when, for example, sheet information is input from the operation panel 105 of the image forming apparatus PR, the CPU of the image forming apparatus PR transmits the sheet information to the CPU 101 of the sheet postprocessing apparatus PD. The sheet postprocessing apparatus PD controls the air blowers 400 based on the received sheet information.

Example 2

Example 2 is an example in which the CPU 101 performs air-blowing control based on setting input by a user from the operation panel 105.

Figure 19:
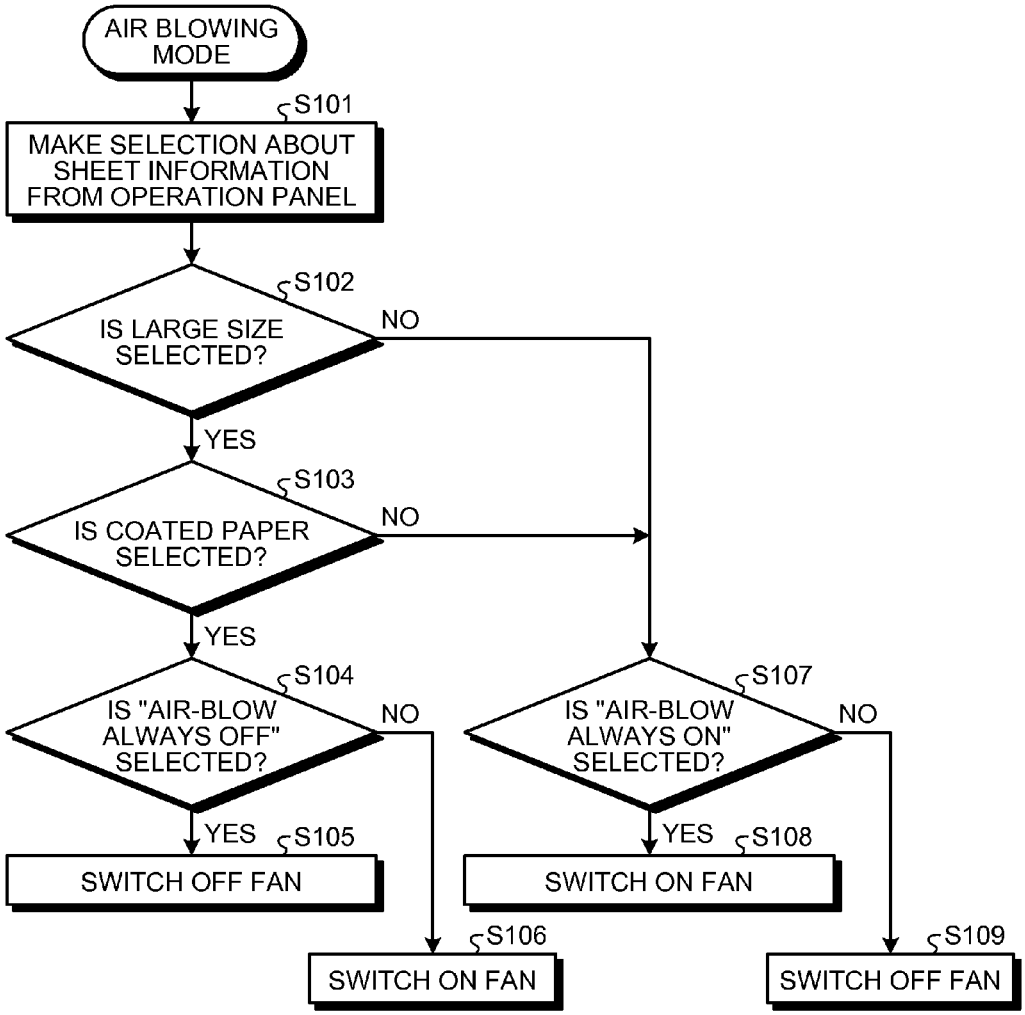
FIG. 19 is a flowchart of an example control operation performed by a CPU when a user has set setting (on/off setting) as to whether air is to be blown by the air blowers.
Figure 20:
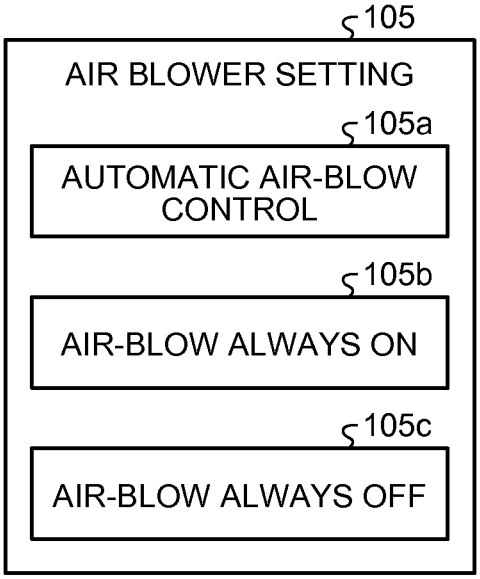
FIG. 20 is a diagram illustrating a setting screen on an operation panel.

FIG. 19 is a flowchart of an example control operation performed by the CPU 101 when a user has set setting (on/off setting) as to whether air is to be blown by the air blowers 400. FIG. 20 is a diagram illustrating a setting screen on the operation panel 105. This flowchart illustrates a procedure in which, in a case where the user has set the setting as to whether air is to be blown, the setting set by the user is given priority over airflow-rate control performed by the CPU 101.

More specifically, a user makes selection about sheet information from the setting screen for the air blowers on the operation panel 105 illustrated in FIG. 20 (Step S101). After selecting is done, determining whether or not LARGE SIZE (sheet length: 364 mm (the length of a B4 sheet in portrait orientation) or longer) is selected from a sheet-size selecting screen (not shown) on the operation panel 105. When LARGE SIZE is selected (YES at Step S102), it is determined whether or not COARTED PAPER is selected (Step S103). When COARTED PAPER is selected (YES at Step S103), it is determine whether or not "AIR-BLOW ALWAYS OFF" 105*c* is selected from the setting screen 105. When "AIR-BLOW ALWAYS OFF" 105*c* is selected (YES at Step S104), the CPU 101 switches off the air blowers 400 (Step S105). When "AIR-BLOW ALWAYS OFF" 105*c* is not selected (NO at Step S104), the CPU 101 switches on the air blowers 400 (Step S106). At Step 102, when LARGE SIZE is not selected (NO at Step S102), it is determined whether or not "AIR-BLOW ALWAYS OFF" 105*c* is selected (Step S107). When "AIR-BLOW ALWAYS OFF" 105*c* is selected (YES at Step S107), the CPU 101 switches on the air blowers 400 (Step S108). When "AIR-BLOW ALWAYS OFF" 105*c* is not selected (NO at Step S107), the CPU 101 switches off the air blowers 400 (Step S109). And, at Step 102, when LARGE SIZE is selected (YES at Step S102) and when COATED PAPER is not selected (NO at Step S103), it is determined whether or not "AIR-BLOW ALWAYS OFF" is selected (Step S107). When "AIR-BLOW ALWAYS OFF" is selected (YES at Step S107), the CPU 101 switches on the air blowers 400 (Step S108). When "AIR-BLOW ALWAYS OFF" is not selected (NO at Step S107), the CPU 101 switches off the air blowers 400 (Step S109).

Even when SMALL SIZE or MEDIUM SIZE is selected (NO at Step S102) or even when LARGE SIZE is selected but COATED PAPER is not selected (NO at Step S103), if "AIR-BLOW ALWAYS ON" 105*b* is not selected from the setting screen (NO at Step S107), the CPU 101 switches off the air blowers 400 (Step S109). Even when SMALL SIZE or MEDIUM SIZE is selected (NO at Step S102) or even when LARGE SIZE is selected but COATED PAPER is not selected (NO at Step S103), if the "AIR-BLOW ALWAYS ON" 105*b* is selected from the setting screen (YES at Step S107), the CPU 101 switches on the air blowers 400 (Step S108).

Meanwhile, when a user selects the "AUTOMATIC AIR-BLOW CONTROL" 105*a* from the setting screen, LARGE SIZE and MEDIUM or SMALL SIZE are selected in a mixed manner, and COATED PAPER is selected, the CPU 101 switches on the air blowers 400. This route is not depicted in the flowchart.

As described above, according to the present embodiment, the air blowers 400 are driven when the sheet information indicates that a sheet to be discharged can cause sheet clinging to occur, and, furthermore, the air velocity of air supplied from the air blowers 400 is controlled based on the sheet information. Accordingly, it is possible to prevent a sheet clinging phenomenon or an inter-sheet close contact phenomenon. Therefore, sheet bending resulting from sheet clinging can be prevented, thereby attaining favorable alignment accuracy in sheet stacking.

According to an aspect of the present invention, it is possible to prevent sheet clinging and sheet bending reliably, thereby attaining favorable alignment accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet discharging device comprising:

a sheet discharging unit configured to receive each of sheets conveyed thereto and discharge the sheets one by one;

a tray unit on which the sheets discharged by the sheet discharging unit are to be stacked;

an air blower configured to blow air through between the sheet discharging unit and the tray unit to one of the sheets that is being discharged;

a control unit configured to control the air blower based on sheet information, wherein the control unit controls whether air is to be blown by the air blower based on the sheet information; and a setting unit configured to set on or off an air-blow by the air blower, wherein when the setting of on or off the air-blow has been set from the setting unit, the setting set from the setting unit is given priority over control performed by the control unit.

2. The sheet discharging device according to claim 1, wherein the air blower includes a unit configured to change an air-blowing direction.

3. The sheet discharging device according to claim 1, wherein a blowing nozzle of the air blower is positioned at a level lower than the sheet discharging unit and higher than the tray unit.

4. The sheet discharging device according to claim 1, wherein the air blower is provided in a plurality, the plurality of air blowers being arranged along a direction perpendicular to a sheet conveying direction.

5. The sheet discharging device according to claim 1, wherein the setting unit is further configured to allow a user to set a velocity of air to be delivered by the air blower.

6. The sheet discharging device according to claim 1, wherein the control unit controls an airflow rate of air to be delivered by the air blower based on the sheet information.

7. An image forming system comprising:

a sheet processing apparatus including a sheet discharging device; and an image forming apparatus arranged upstream of the sheet processing apparatus and supplying sheets on each of which an image is formed to the sheet processing apparatus wherein the sheet discharging device includes;

a sheet discharging unit configured to receive each of sheets conveyed thereto and discharge the sheets one by one;

a tray unit on which the sheets discharged by the sheet discharging unit are to be stacked;

an air blower configured to blow air through between the sheet discharging unit and the tray unit to one of the sheets that is being discharged;

a control unit configured to control the air blower based on sheet information, wherein the control unit controls whether air is to be blown by the air blower based on the sheet information; and a setting unit configured to set on or off an air-blow by the air blower, wherein when the setting of on or off the air-blow has been set from the setting unit, the setting set from the setting unit is given priority over control performed by the control unit.

8. The image forming system according to 7, further comprising a sheet detector configured to detect a sheet discharged from the sheet discharging unit, wherein the air blower starts blowing air when the image forming apparatus starts feeding the sheets to the sheet processing apparatus, and stops blowing air after the sheet detector has detected that last sheet of the sheets has been ejected.

9. A sheet discharging method comprising:

discharging, by a discharging unit, each of sheets conveyed to the discharging unit one by one;

stacking the sheets discharged by the sheet discharging unit on a tray unit;

blowing air, by an air blower, from between the sheet discharging unit and the tray unit to one of the sheets that is being discharged;

controlling, by a control unit, whether air is to be blown by the air blower based on sheet information; and setting on or off an air-blow by the air blower, wherein when the setting of on or off the air-blow has been set from a setting unit, the setting set from the setting unit is given priority over control performed by the control unit.

* * * * *